US009041641B2

(12) United States Patent
Honbo et al.

(10) Patent No.: US 9,041,641 B2
(45) Date of Patent: May 26, 2015

(54) LIQUID CRYSTAL DISPLAY DEVICE, DRIVING CONTROL CIRCUIT AND DRIVING METHOD USED IN SAME

(75) Inventors: Nobuaki Honbo, Kanagawa (JP); Hiroshi Hada, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 924 days.

(21) Appl. No.: 11/711,829

(22) Filed: Feb. 28, 2007

(65) Prior Publication Data

US 2008/0018587 A1 Jan. 24, 2008

(30) Foreign Application Priority Data

Mar. 1, 2006 (JP) ..... 2006-055600

(51) Int. Cl.
*G09G 3/36* (2006.01)
*G09G 3/34* (2006.01)

(52) U.S. Cl.
CPC ..... *G09G 3/3406* (2013.01); *G09G 3/3648* (2013.01); *G09G 2310/0245* (2013.01); *G09G 2340/0435* (2013.01); *G09G 2340/16* (2013.01)

(58) Field of Classification Search
CPC ..... G09G 2310/0237
USPC ..... 345/102
See application file for complete search history.

(56) References Cited

U.S. PATENT DOCUMENTS 6,803,894 B1 * 10/2004 Hirota et al. ..... 345/88
7,098,884 B2 * 8/2006 Onoya ..... 345/96
7,333,101 B2 * 2/2008 Bu et al. ..... 345/208
2002/0011974 A1 * 1/2002 Holtslag ..... 345/76
2002/0067324 A1 * 6/2002 Aoki ..... 345/87
2004/0012551 A1 * 1/2004 Ishii ..... 345/87
2004/0104880 A1 * 6/2004 Kang et al. ..... 345/94
2005/0083282 A1 * 4/2005 Honbo ..... 345/87
2005/0184944 A1 * 8/2005 Miyata et al. ..... 345/89
2006/0109234 A1 * 5/2006 Hong et al. ..... 345/102
2006/0125715 A1 * 6/2006 Choi ..... 345/14

(Continued)

FOREIGN PATENT DOCUMENTS

JP 11-258573 A 9/1999
JP 2000-322029 A 11/2000

(Continued)

OTHER PUBLICATIONS

Communication dated Nov. 8, 2011, issued by the Japanese Patent Office in corresponding Japanese Patent Application No. 2006-055600.

*Primary Examiner* — William Boddie
*Assistant Examiner* — Carolyn R Edwards
(74) *Attorney, Agent, or Firm* — Sughrue Mion, PLLC

(57) ABSTRACT

A liquid crystal display device is provided which improves quality of images made up of moving images and images having moving images and still images in a mixed manner. Each frame of an input video signal having a specified frame frequency (60 Hz) is divided into four sub-frames each having a frequency being four times as large as the specified frame frequency and, after an overdriving operation is performed in the first sub-frame on each pixel region of a liquid crystal display panel, a normal driving operation is performed in the second sub-frame and thereafter, and in which a backlight flashes two times at a frequency being two times as large as a frame frequency (120 Hz) of the first frame frequency during one frame period in specified time intervals.

15 Claims, 13 Drawing Sheets

(56) References Cited

U.S. PATENT DOCUMENTS

| | | | | |
|---|---|---|---|---|
| 2006/0139298 | A1* | 6/2006 | Jin et al. | 345/102 |
| 2006/0202927 | A1* | 9/2006 | Lee | 345/88 |

FOREIGN PATENT DOCUMENTS

| | | | |
|---|---|---|---|
| JP | 2002-91400 | A | 3/2002 |
| JP | 2002-156950 | A | 5/2002 |
| JP | 2002-318395 | A | 10/2002 |
| JP | 2002-366124 | A | 12/2002 |
| JP | 2003-36056 | A | 2/2003 |
| JP | 2003-66449 | A | 3/2003 |
| JP | 2003-131635 | A | 5/2003 |
| JP | 2003-172915 | A | 6/2003 |
| JP | 2003-241721 | A | 8/2003 |
| JP | 2004-93717 | A | 3/2004 |
| JP | 2004-163829 | A | 6/2004 |
| JP | 2004-233932 | A | 8/2004 |
| JP | 2004-240410 | A | 8/2004 |
| JP | 2004-264828 | A | 9/2004 |
| JP | 2004-355017 | A | 12/2004 |
| JP | 2006-267303 | A | 10/2006 |

* cited by examiner

LIQUID CRYSTAL DISPLAY DEVICE, DRIVING CONTROL CIRCUIT AND DRIVING METHOD USED IN SAME

BACKGROUND OF THE INVENTION

1. Field of the Invention

The present invention relates to a liquid crystal display device, a driving control circuit to be used in the liquid crystal display device, and a method for driving the liquid crystal display device and more particularly to the liquid crystal display device having an LED (Light Emitting Diode) backlight being able to be suitably used when only moving images and moving/still images having moving images and still images in a mixed manner are displayed, to the driving control circuit, and to the method for driving the liquid crystal display device.

The present application claims priority of Japanese Patent Application No. 2006-055600 filed on Mar. 1, 2006, which is hereby incorporated by reference.

2. Description of the Related Art

In recent years, a liquid crystal display device has been used not only as a monitor of a personal computer but also as various displays such as a liquid crystal television set or a like. When the liquid crystal display device is used for such as an application to the television set or the like, performance of displaying moving images is essential. However, in the conventional liquid crystal display device, when a moving image is to be displayed, a succeeding image is displayed with a current image still persisting in a user's consciousness and, as a result, the current image is perceived by the user as an after-image. The reason for this is that much time is required for a response of a liquid crystal to an applied voltage and that a holding-type driving operation is performed in which a current frame is held till a displaying signal corresponding to a succeeding image is supplied.

The after-image caused by the response of the liquid crystal can be reduced by speeding up the response of the liquid crystal by performing an overdriving operation in which an over-voltage is applied to the liquid crystal. Also, the after-image caused by the holding-type driving operation can be reduced, as in the case of a CRT (Cathode Ray Tube) display device, by performing an impulse driving operation in which an image is displayed only for a moment. The impulse driving operation includes a method in which a black image is displayed in an inserted manner after an image is displayed on a liquid crystal display panel during one frame period (called a "black inserting driving method") and a method in which a backlight is turned on after a specified voltage is applied in a pixel region (called a "backlight blinking method").

Conventional technology of this type is disclosed in the following Patent Reference. In the liquid crystal display device disclosed in Patent Reference 1 (Japanese Patent Application Laid-open No. 2004-163829, page 7, FIG. 2), impulse driving operations based on the backlight blinking method are performed and, as shown in FIG. 12, after a liquid crystal comes to have specified optical transmittance with a time delay corresponding to response time of the liquid crystal following the completion of scanning for all the periods (writing of images) on a display screen, a driving waveform is applied to a backlight source. The backlight source illuminates simultaneously all the display screens at the same frequency as a frame frequency (60 Hz) during a backlight turning-on period. This enables reduction in blurring of moving images caused by a response of a liquid crystal and by a holding-type driving operation.

In the conventional liquid crystal display device disclosed in Patent Reference 2 (Japanese Patent Application Laid-open No. 2004-233932, page 6, FIG. 2), black insertion driving is performed and one frame for input data shown in FIG. 13(*a*) is divided into two frames in which the data input is read twice from the frame memory as shown in FIG. 13(*b*). Based on a controlling signal from a CPU (Central Processing Unit), a video signal or a black display signal is written on a liquid crystal display panel. In this case, as shown in FIG. 13(*c*), black displaying signals 1, 3, and 5 and video signals 2, 4, and 6 are written on the liquid crystal display panel. This enables suppression of blurring of moving images in the holding-type displaying.

However, the above conventional liquid crystal display device has the following problem. That is, the problem arises that, though, in the conventional technology, combination of the overdriving and impulse driving methods improves quality of moving images, a flicker occurs when the black insertion method or backlight blinking method are performed in a region having many images standing still on a display screen at a normal frame frequency (60 Hz). When an LED is used as a backlight source, a response of the LED in its turning-on to its turning-off states or vice versa is more rapid than that of a CRT and, therefore, quality of moving images by using the backlight blinking is greatly improved, however, a greater flicker occurs.

Also, another problem is that, in the conventional display device disclosed in Patent Reference 1, blurring of moving images caused by a response of a liquid crystal and caused by the holding-type driving method can be reduced, however, the backlight source flashes at the same frequency as the frame frequency and, as a result, a flicker occurs.

Moreover, in the conventional liquid crystal display device disclosed in the Patent Reference 2, a problem arises that blurring of moving images caused by the holding-type displaying can be suppressed, however, an influence of a response delay of a liquid crystal appears on a display screen and, therefore, improvement of quality of moving images can not be expected when compared with the case where the LED backlight is made to flash.

SUMMARY OF THE INVENTION

In view of the above, it is an object of the present invention to provide a liquid crystal display device capable of preventing occurrence of a flicker even when a backlight is used as a light source, a driving control circuit to be used for the liquid crystal display device, and a method for driving the liquid crystal display device.

According to a first aspect of the present invention, there is provided a liquid crystal display device including:

a liquid crystal display panel having scanning electrodes and data electrodes to apply a specified voltage to a corresponding pixel region and to control orientation of a liquid crystal to obtain a displayed image;

a backlight to illuminate the liquid crystal display panel from its rear side; and a driving control unit to divide each frame of an input video signal to be input at a specified frame frequency into M-pieces (M is an integer being 4 or more) of sub-frames each having a sub-frame frequency being M times as large as the specified frame frequency and to perform an overdriving operation on the corresponding pixel region during one frame period in a first sub-frame and to perform a normal driving operation during one frame in a second sub-frame and thereafter and to make the backlight flash N (N is an integer being 2 or more) times at specified time intervals.

In the foregoing, a preferable mode is one wherein the backlight is made up of LEDs.

Also, a preferable mode is one wherein the driving control unit turns off the backlight before a response of a liquid crystal of the corresponding pixel region to application of the specified voltage is completed and turns on the backlight at a time point when the response is completed.

Also, a preferable mode is one wherein the time point when the response of the liquid crystal is completed is set to a time point when the response of the liquid crystal is reached to more than 70% of liquid crystal molecules.

Also, a preferable mode is one wherein the driving control unit inverts a polarity of the voltage to be applied to the corresponding pixel region in the first sub-frame in each of continuous frames.

Also, a preferable mode is one wherein the driving control unit applies, when making the backlight flash two times or more during one frame, a voltage to the corresponding pixel region in a manner in which a polarity of the voltage is changed in every period during which the backlight is being lit.

Also, a preferable mode is one wherein each of the data electrodes of the liquid crystal display panel is arranged in parallel to one another in a first direction at specified intervals and each of the scanning electrodes is arranged in parallel to one another in a second direction orthogonal to the first direction at specified intervals and wherein a light emitting region of said backlight is divided into k (k is an integer being 2 or more)-pieces of light source blocks along said second direction of said liquid crystal display panel and wherein said driving control unit is so configured as to make said plurality of light source blocks flash in a manner to correspond to a response of said liquid crystal corresponding to each of said light source blocks of a light emitting region.

According to a second aspect of the present invention, there is provided a driving control circuit to be used for a liquid crystal display device which includes a liquid crystal display panel and a backlight to illuminate the liquid crystal display panel from its rear side, wherein the liquid crystal display panel drives scanning electrodes and data electrodes to apply a specified voltage to a corresponding pixel region and to control orientation of a liquid crystal to obtain a displayed image and wherein the driving control circuit divides each frame of an input video signal to be input at a specified frame frequency into M-pieces (M is an integer being 4 or more) of sub-frames each having a sub-frame frequency being M times as large as the specified frame frequency and to perform an overdriving operation on the corresponding pixel region during one frame period in a first sub-frame and to perform a normal driving operation during one frame in a second sub-frame and thereafter and to make the backlight to flash N (N is an integer being 2 or more) times at specified time intervals.

According to a third aspect of the present invention, there is provided a driving method to be used for a liquid crystal display device which includes a liquid crystal display panel and a backlight to illuminate the liquid crystal display panel from its rear side, wherein the liquid crystal display panel drives scanning electrodes and data electrodes to apply a specified voltage to a corresponding pixel region and to control orientation of a liquid crystal to obtain a displayed image, the driving method including:

a step of dividing each frame of an input video signal to be input at a specified frame frequency into M-pieces (M is an integer being 4 or more) of sub-frames each having a sub-frame frequency being M times as large as the specified frame frequency, a step of performing an overdriving operation on the corresponding pixel region during one frame period in a first sub-frame, a step of performing a normal driving operation during one frame period in a second sub-frame and thereafter and a step of making the backlight to flash N (N is an integer being 2 or more) times at specified time intervals.

With the above configurations, each frame of an input video signal to be input at a specified frequency is divided into M-pieces of sub-frames each having a sub-frame frequency being M (M is an integer being 4 or more) times as large as the specified frame frequency and an overdriving operation is performed on each of pixel regions in the first frame during one frame period and a normal driving operation is performed during one frame in the second and thereafter and a backlight flashes N (N is an integer being 2 or more) times at specified time intervals and, therefore, even if a response of a liquid crystal is not rapid, blurring of moving images can be prevented and occurrence of a flicker of an image caused by flashing of a light source can be avoided. Moreover, a voltage is applied to each of pixel regions in a manner in which a polarity of the applied voltage is changed for every period during which the backlight is being lit and, therefore, a frequency at which the polarity of the voltage is changed becomes high, thereby enabling reduction of a flicker caused by the change in polarity of the voltage.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings. According to the embodiment, a liquid crystal display device is provided in which each frame of an input video signal VD having a specified frame frequency (60 Hz) is divided into four sub-frames each having a frequency being four times as large as the specified frame frequency and, after an overdriving operation is performed in the first sub-frame on each pixel region of a liquid crystal display panel, a normal driving operation is performed in the second sub-frame and thereafter and in which a backlight flashes two times at a frequency being two times as large as the first frame frequency (120 Hz) during one frame period at specified time intervals, and a driving control circuit to be used for the liquid crystal display device and a method of driving the above liquid crystal display device are disclosed.

First Embodiment

Figure 1:
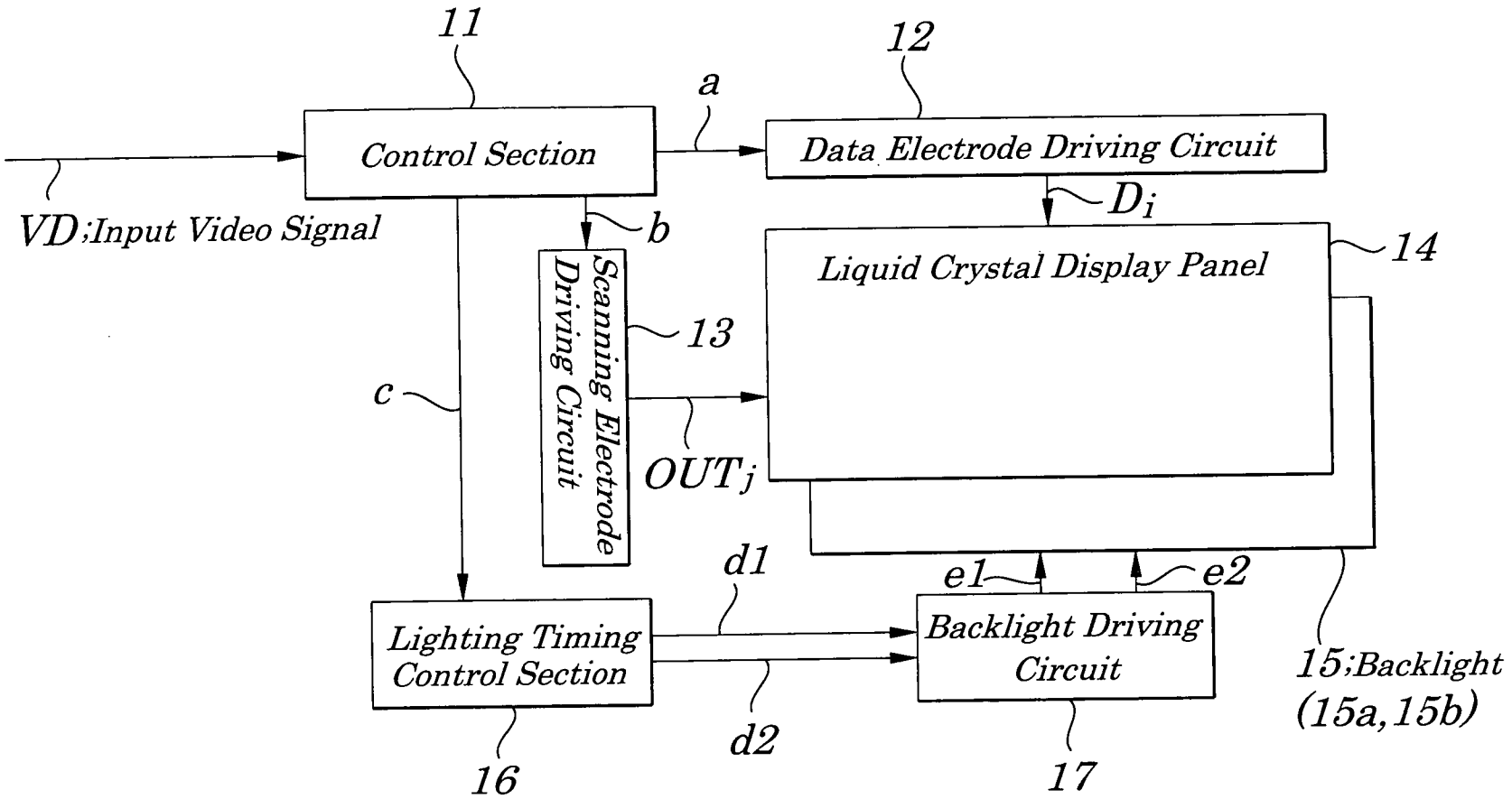
FIG. 1 is a block diagram showing electrical configurations of main components of a liquid crystal display device according to a first embodiment of the present invention.

FIG. 1 is a block diagram showing electrical configurations of main components of a liquid crystal display device of a first embodiment of the present invention. The liquid crystal display device of the first embodiment includes, as shown in FIG. 1, a control section 11, a data electrode driving circuit 12, a scanning electrode driving circuit 13, a liquid crystal display panel 14, a backlight 15, a lighting timing control section 16, and a backlight driving circuit 17.

Figure 2:
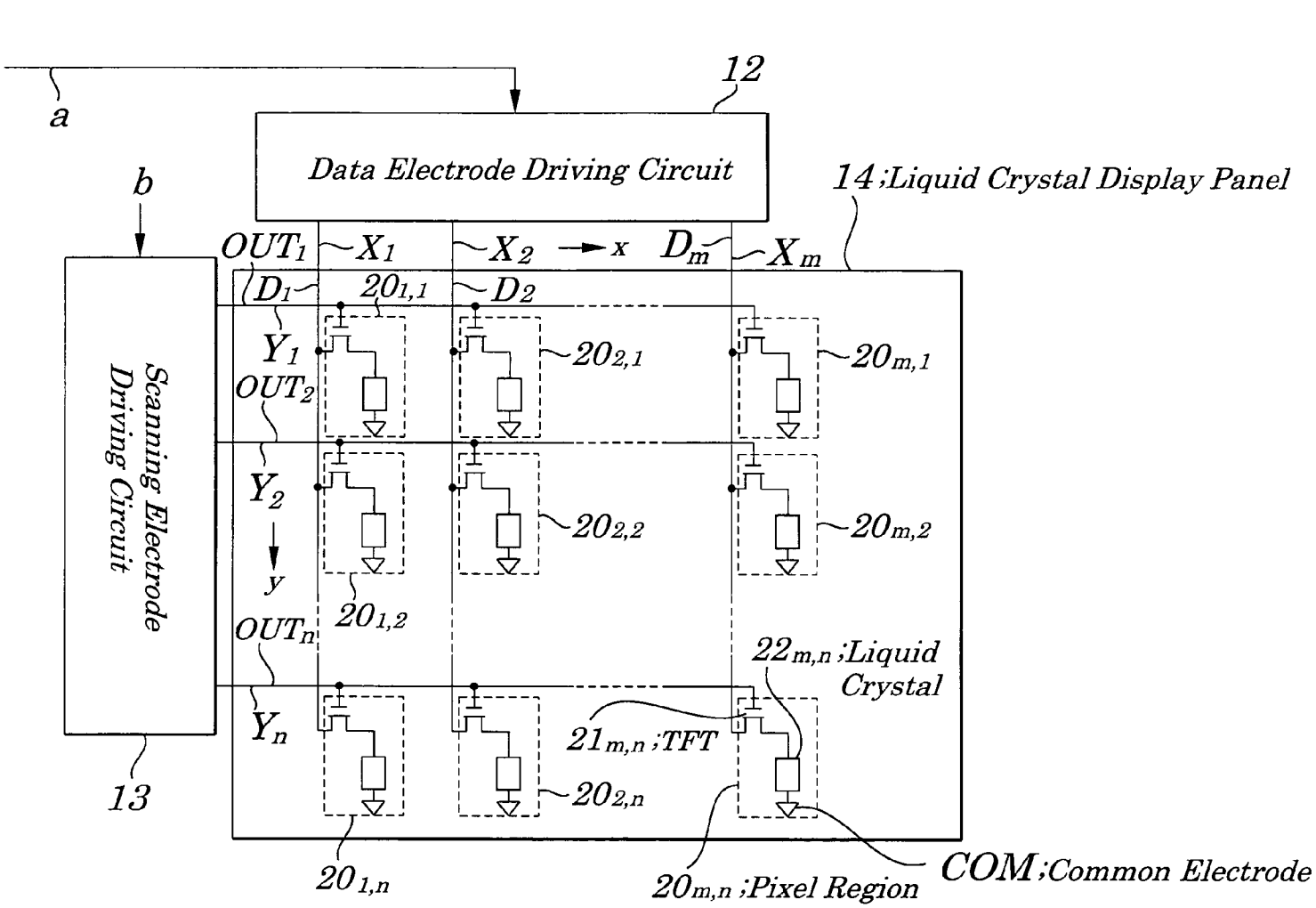
FIG. 2 is a schematic circuit diagram showing an example of electrical configurations of a liquid crystal display panel shown in FIG. 1.

FIG. 2 is a schematic circuit diagram showing an example of electrical configurations of the liquid crystal display panel 14 shown in FIG. 1. The liquid crystal display panel 14 is of a transmission-type which allows light of the backlight 15 to enter and, as shown in FIG. 2, includes data electrodes $X_i$ (i=1, 2, . . . , m, for example, m=640×3), scanning electrodes $Y_j$ (j=1, 2, . . . , n, for example, n=512), and pixel regions $\mathbf{20}_{i,j}$. The data electrodes $X_i$ are mounted at specified intervals in an x direction (first direction) to each of which a corresponding displaying signal $D_i$ is applied. The scanning electrodes $Y_j$ are mounted at specified intervals in a y direction (scanning direction, second direction) orthogonal to the x direction to each of which a scanning signal $OUT_j$ is line-sequentially applied to write the displaying signal $D_i$. The pixel regions $\mathbf{20}_{i,j}$ are mounted in a manner to correspond, in one-to-one relationship, to an intersecting region between each of the data electrodes $X_i$ and each of the scanning electrodes $Y_j$ and includes TFTs (Thin Film Transistor) $\mathbf{21}_{i,j}$, liquid crystals $\mathbf{22}_{i,j}$ and common electrodes COM. Each of the TFTs $\mathbf{21}_{i,j}$ is ON/OFF controlled according to the scanning signal OUT and a displaying signal $D_i$ is applied to each of the liquid crystals $\mathbf{22}_{i,j}$ when changing into an ON state.

In the liquid crystal display panel 14 of the embodiment, when each of the scanning electrodes $Y_j$ and each of the data electrodes $X_i$ are driven, that is, when the scanning signal $OUT_j$ is line-sequentially applied to each of the scanning electrodes $Y_j$ and a corresponding displaying signal $D_i$ is written into each of the data electrodes $X_i$, a specified voltage is applied to the pixel region corresponding to the displaying signal $D_i$ and an orientation state of a liquid crystal making up a liquid crystal layer of the liquid crystal display panel 14 is controlled based on the applied specified voltage and, as a result, optical transmittance is changed, thus allowing a displayed image to be obtained. The data electrode driving circuit 12 applies simultaneously the displaying signal $D_i$ to each of data electrodes $X_i$ based on a controlling signal "a" fed from the control section 11. The scanning electrode driving circuit 13 applies line-sequentially the scanning signal $OUT_j$ to each of the scanning electrodes $Y_j$ of the liquid crystal display panel 14 based on a controlling signal "b" fed from the control section 11.

Figure 3:
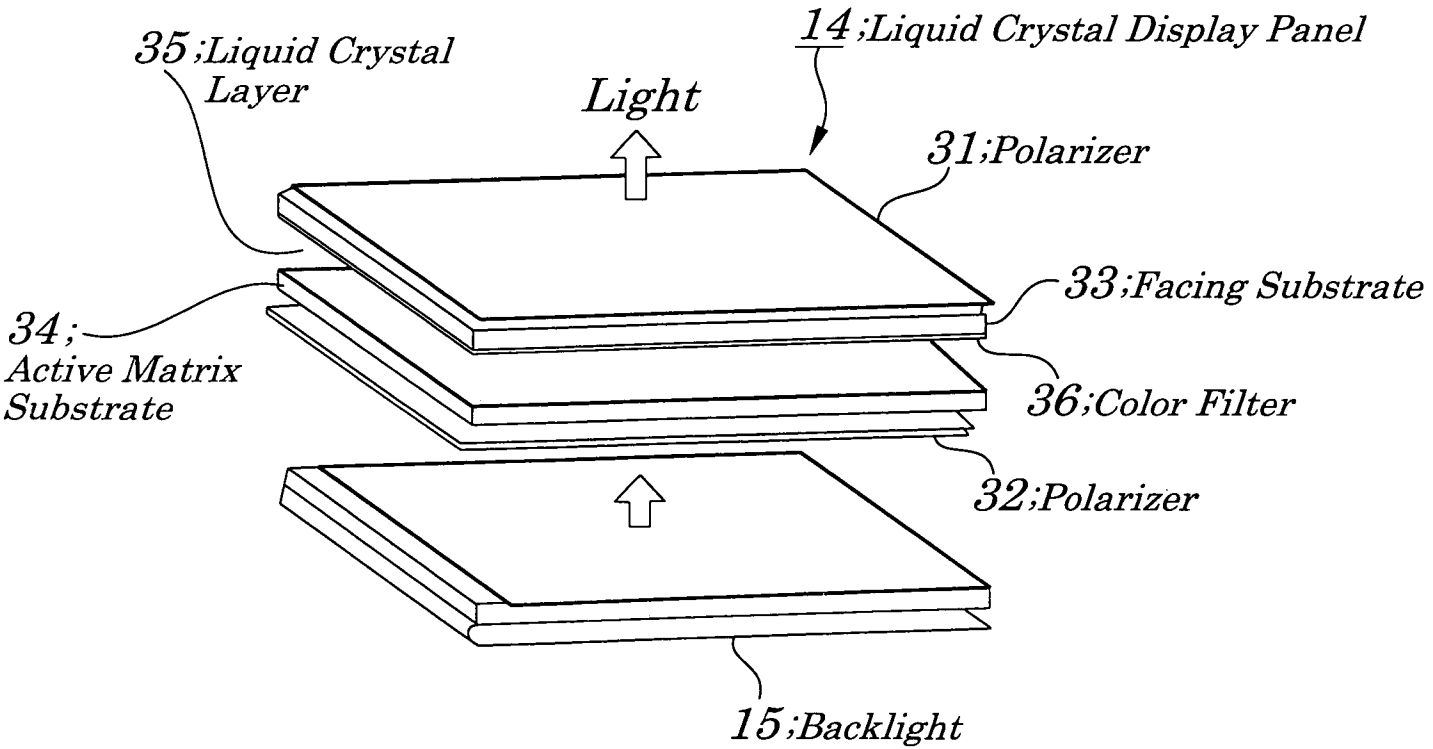
FIG. 3 is a diagram schematically showing configurations of the liquid crystal display panel shown in FIG. 1 and a position of a backlight.

FIG. 3 is a diagram schematically showing configurations of the liquid crystal display panel 14 shown in FIG. 1 and a position of the backlight 15. The liquid crystal display panel 14 includes, as shown in FIG. 3, a pair of polarizers 31 and 32, a facing substrate 33, an active matrix substrate 34 and a liquid crystal layer 35 interposed between the active matrix substrate 34 and the facing substrate 33. On the facing substrate 33 are formed the common electrodes COM and a color filter 36 of red (R), green (G), and blue (B). Three pixels having three colors of R, G, and B make up one dot. On the active matrix substrate 34 are mounted active elements such as TFT $\mathbf{21}_{i,j}$ shown in FIG. 2. The backlight 15 is attached to a rear side of the liquid crystal display panel 14 and, in the embodiment in particular, an LED is used as a flat light source and is configured to have a size being almost the same as that of the display screen of the liquid crystal display panel 14 as a whole.

In the liquid crystal display panel 14, white light from the backlight 15 passes through the polarizer 32 and then comes in the liquid crystal layer 35 as linearly polarized light. The liquid crystal layer 35 is, for example, of a TN (Twisted Nematic)-type liquid crystal and is configured to change a shape of the polarized light, however, this operation is predetermined by the orientation state of the liquid crystal and, therefore, the shape of the polarized light is controlled by a voltage corresponding to a displaying signal $D_i$. Whether or not emitted light is absorbed by the polarizer 32 is determined depending on a shape of the polarized light emitted from the liquid crystal layer 35. Thus, optical transmittance is controlled by a voltage corresponding to the displaying signal $D_i$. A color image is obtained by additive mixture of color stimuli of light having passed through each pixel of R, G, and B of the color filter 36.

Figure 4:
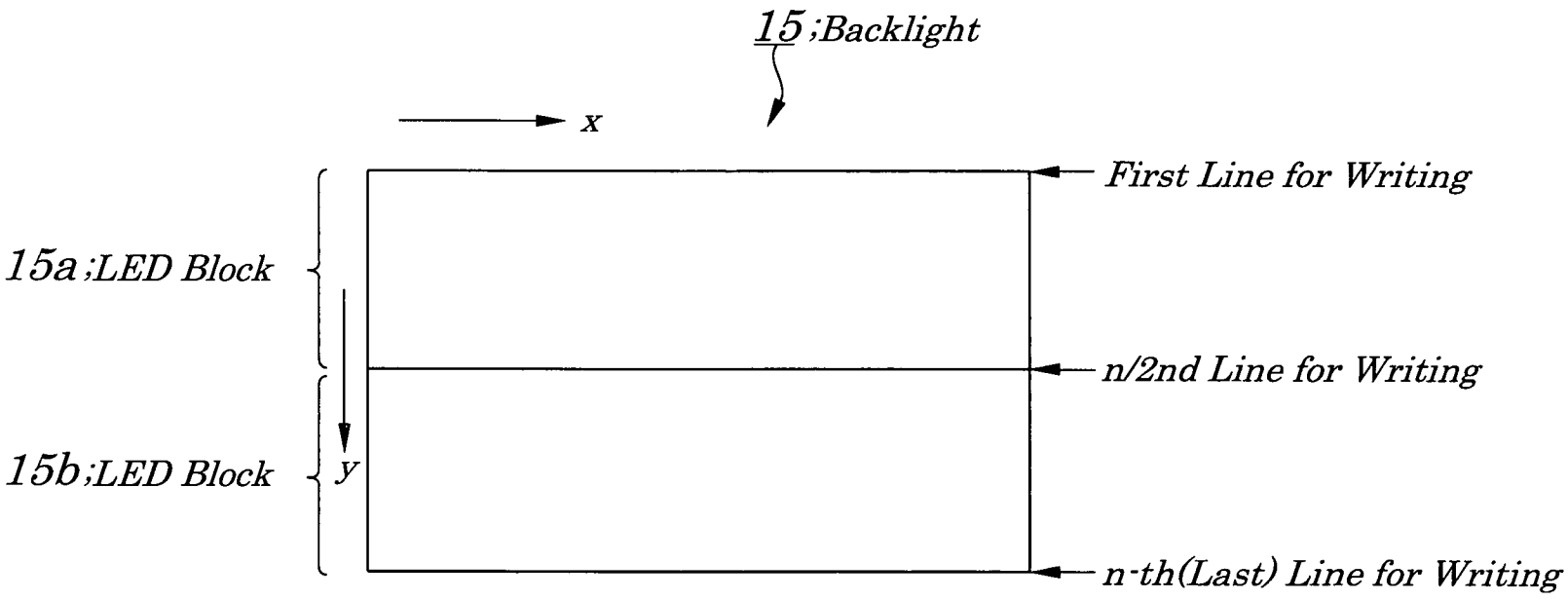
FIG. 4 is a diagram showing configurations of main components of the backlight shown in FIG. 1.

FIG. 4 is a diagram showing configurations of main components of the backlight shown in FIG. 1. In the backlight 15, as shown in FIG. 4, the light emitting region is divided into two portions in a y direction (second direction) of the liquid crystal display panel 14, that is, the light emitting region is made up of LED blocks 15*a* and 15*b*. In this case, the scanning signal $OUT_j$ is written (applied) to the liquid crystal display panel 14 line-sequentially in a direction from the $1^{st}$ line to the n-th (last) line of the scanning electrodes $Y_j$; however, since the backlight 15 is divided into two portions in the neighborhood of the $n/2^{nd}$ line, the scanning signal $OUT_j$ is applied to two regions.

The control section 11 shown in FIG. 1 sends out a controlling signal "a" to the data electrode driving circuit 12, a controlling signal "b" to the scanning electrode driving circuit 13, and a controlling signal "c" to the lighting timing control section 16, based on an input video signal. In the embodiment in particular, the control section 11 divides each frame of an input video signal VD having a specified frame frequency into four sub-frames each having a sub-frame frequency four times as large as the specified frequency and performs an overdriving operation in the first sub-frame and a normal driving operation in the second sub-frame and thereafter on each of the pixel regions $\mathbf{20}_{i,j}$. Moreover, the control section 11 inverts, for every frame, the polarity of a voltage of the displaying signal $D_i$ to be applied to each of the pixel regions $\mathbf{20}_{i,j}$ or makes the polarity become the same for every sub-frame. Also, the control section 11 inverts, in each of continuous frames, the polarity of a voltage of the displaying signal $D_i$ to be applied to each of the pixel regions $\mathbf{20}_{i,j}$ in the first sub-frame. Furthermore, the frame frequency is 60.00 Hz in the case of specifications of the liquid crystal display panel 14 being XGA (Extended Graphics Array) and 59.94 Hz for VGA (Video Graphics Array) and 60.32 Hz for SVGA (Super Video Graphics Array).

The lighting timing control section 16 is made up of a plurality of logical circuits or a like and generates, based on the controlling signal "c" fed from the control section 11, timing signals "d1" and "d2" to make each of the LED blocks 15*a* and 15*b* flash two times in specified time intervals during one frame period at a frequency being two times as large as the frame frequency. In the embodiment in particular, the lighting timing control section 16 turns off the backlight 15 before the completion of a response of each of the liquid crystals $\mathbf{22}_{i,j}$ to the application of the displaying signal $D_i$ and turns on the backlight 15 at the time of completion of the response. Timing for turning on and off the backlight 15 is pre-determined in a manner to correspond to a period during which changes in transmittance are great since major changes of the liquid crystals $\mathbf{22}_{i,j}$ occur while the backlight 15 is turned off and to correspond to a steady-state period since the changes of the liquid crystals $\mathbf{22}_{i,j}$ are completed while the backlight 15 is turned on.

The backlight driving circuit 17, by using, for example, a commercial power source, generates driving pulse voltages "e1" and "e2" in synchronization with the timing signals "d1" and "d2" fed from the lighting timing control section 16 and applies the voltages to each of the LED blocks 15*a* and 15*b* of the backlight 15. The above control section 11, the data electrode driving circuit 12, the scanning electrode driving circuit 13, and the backlight driving circuit 17 make up a driving control circuit.

Figure 5:
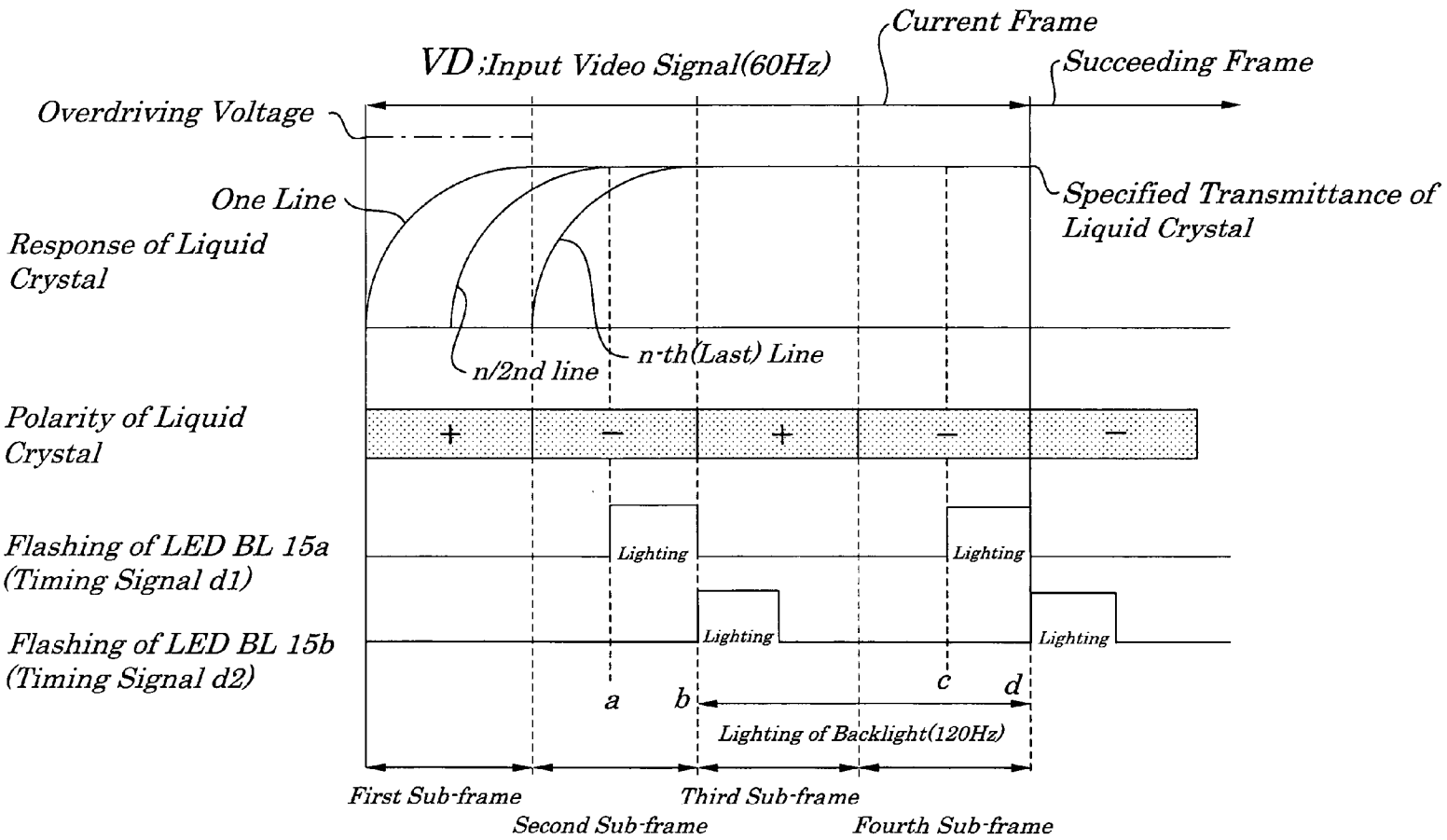
FIG. 5 is a time chart explaining operations of the liquid crystal display device shown in FIG. 1.

FIG. 5 is a time chart explaining operations of the liquid crystal display device shown in FIG. 1. By referring to FIG. 5, processing for driving methods of the liquid crystal display device is described. In the liquid crystal display device, each frame of the input video signal VD having a specified frame frequency is divided into four sub-frames each having a sub-frame frequency as large as the specified frame frequency and, after overdriving operations are performed in the first sub-frame on each of the pixel regions $\mathbf{20}_{i,j}$, normal driving operations are performed in the second sub-frame and thereafter on each of the pixel regions $\mathbf{20}_{i,j}$ and the LED blocks 15*a* and 15*b* making up the backlight 15 flash two times at frequency two times as large as the frame frequency in specified time intervals during one frame period.

That is, as shown in FIG. 5, one frame (current frame) of the input video signal VD is divided into four sub-frames (first frame to fourth frame) and the frequency of the displaying signal $D_i$ to be written into the liquid crystal display panel 14 is four times larger than that before the division. In the first sub-frame, an overdriving operation is performed so that a response of the liquid crystals $\mathbf{22}_{i,j}$ is made rapid and, in the second to fourth sub-frame, a normal driving operation is performed. The LED block (BL) 15*a* starts its lighting at the time point "a" when a response of the liquid crystals $\mathbf{22}_{i,j}$ on the $n/2^{nd}$ line of the liquid crystal display panel 14 is almost complete (for example, at the first time point when 70% or more of the response of the liquid crystals $\mathbf{22}_{i,j}$ is reached, more preferably at the second time point when 90% or more is reached) and is turned off around at the time point "b" when writing on the first line of the third sub-frame is started. Also, the LED block 15*a* is again turned on at the time period from "c" to "d". Therefore, the LED block 15*a*, when a frame frequency of the input video signal VD is 60 Hz, flashes at a frequency of 120 Hz. Moreover, the time period "a" to "b" are approximately the same as the time period "c" to "d" and, in the embodiment in particular, the time period is 12.5% of one frame.

Similarly, the LED block (BL) 15*b* starts lighting at the time point "b" when a response for the n-th (last) line of the liquid crystal display panel 14 is almost complete (70% or more of the response of the liquid crystals $\mathbf{22}_{i,j}$, more preferably 90% or more is reached) and turns off at the time point when writing for the $n/2^{nd}$ line of the third sub-frame starts for $n/2^{nd}$ line starts and turns off at the time point "d" when a succeeding frame starts. Due to this, the LED block 15*b* flashes at a frequency of 120 Hz. The period while the LED block 15*a* is lighting is almost the same as that while the LED block 15*b* is lighting. The polarity of a voltage of the displaying signal $D_i$ to be applied to the pixel regions $\mathbf{20}_{i,j}$ of the liquid crystal display panel 14, if being positive in the first sub-frame of the current frame, becomes negative in the second sub-frame and becomes positive in the third sub-frame and negative in the fourth sub-frame. Moreover, in this case, the polarity of the voltage of the displaying signal $D_i$ may be the same during all the periods from the first to fourth sub-frame. After that, in the first sub-frame of the succeeding frame, the polarity of the voltage of the displaying signal $D_i$ becomes negative. Thus, the polarity of the voltage of the displaying signal $D_i$ during which an overdriving operation is performed is inverted in every frame.

As described above, in the first embodiment, each frame of the input video signal VD having a specified frame frequency (60 Hz) is divided into four sub-frames each having a sub-frame frequency being four times as large as the specified frequency and an overdriving operation is performed in the first sub-frame and a normal driving operation is performed in the second sub-frame and thereafter on each of the pixel regions $\mathbf{20}_{i,j}$ and, in a manner to correspond to a response characteristic, each of the LED blocks 15*a* and 15*b* flashes two times at specified time intervals during one frame period at a frequency (120 Hz) being two times as large as the frame frequency. As a result, even if a response of the liquid crystals $\mathbf{22}_{i,j}$ is not rapid, blurring of moving images on the display screen can be avoided and a flicker on the display screen caused by the flashing of the backlight does not occur.

Second Embodiment

Figure 6:
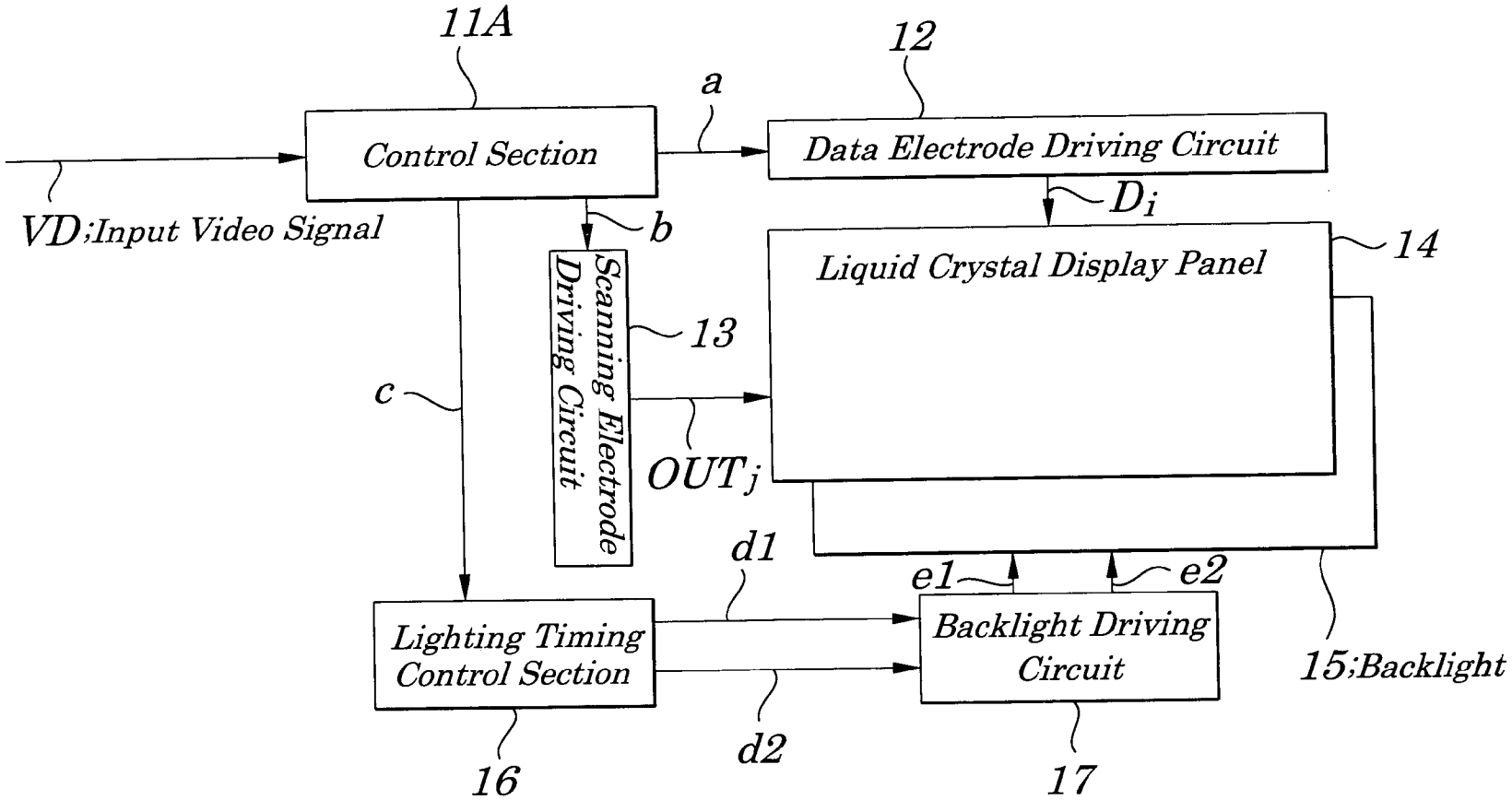
FIG. 6 is a block diagram showing electrical configurations of main components of a liquid crystal display device according to a second embodiment of the present invention.

FIG. 6 is a block diagram showing electrical configurations of main components of a liquid crystal display device according to a second embodiment of the present invention. In FIG. 6, the same reference numbers are assigned to common components having the same functions as in the first embodiment shown in FIG. 1. In the liquid crystal display device of the second embodiment, as shown in FIG. 6, instead of a control section 11, a control section 11A having functions being different from those of the control section 11 is incorporated newly. The control section 11A, when making each of LED blocks 15*a* and 15*b* flash two times during one frame, applies a voltage to each of pixel regions $\mathbf{20}_{i,j}$ in a manner in which the polarity of the voltage changes in every period during which the LED blocks 15*a* and 15*b* are being lit. Configurations other than described here are the same as in FIG. 1.

Figure 7:
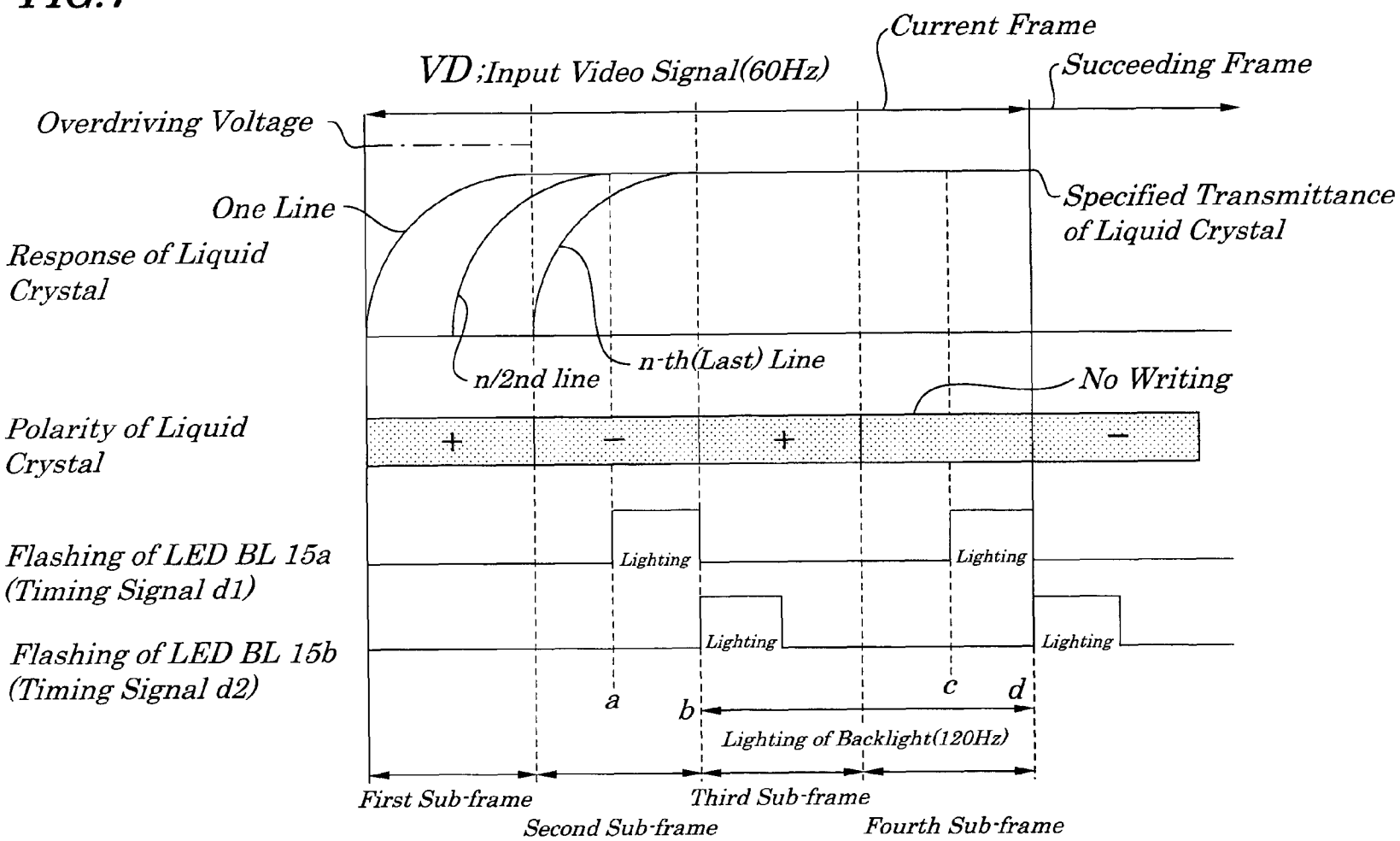
FIG. 7 is a time chart explaining operations of the liquid crystal display device of FIG. 6.

FIG. 7 is a time chart explaining operations of the liquid crystal display device of FIG. 6. By referring to FIG. 7, processing of driving the liquid crystal display device is described below. In the liquid crystal display device of the second embodiment, as shown in FIG. 7, a polarity of a voltage of a displaying signal $D_i$ to be applied to each of the pixel regions $\mathbf{20}_{i,j}$ of a liquid crystal display panel 14, if being positive in a first sub-frame of a current frame, becomes negative in a second sub-frame and positive in a third sub-frame being different from the second sub-frame and positive in a fourth sub-frame as in the case of the sub-third frame. In the fourth sub-frame, instead, the polarity in the third sub-frame may be maintained as it is, without an application of the displaying signal $D_i$ to the pixel regions $\mathbf{20}_{i,j}$. Moreover, the polarity may be negative as in the second sub-frame. After that, as in the case of the first embodiment, in the first sub-frame of the succeeding frame, the polarity of the voltage of the displaying signal $D_i$ becomes negative and the polarity of the voltage of the displaying signal $D_i$ in the first sub-frame is inverted in every frame.

Thus, in the second embodiment, the voltage is applied to each of the pixel regions $\mathbf{20}_{i,j}$ in a manner in which the polarity of the voltage changes in every period during which the LED blocks 15*a* and 15*b* are being lit and, therefore, the frequency at which the polarity of the voltage of the displaying signal $D_i$ is changed becomes high, which enables an decrease in a flicker caused by changes in the polarity. This is an advantage to be added to advantages obtained in the first embodiment.

Third Embodiment

Figure 8:
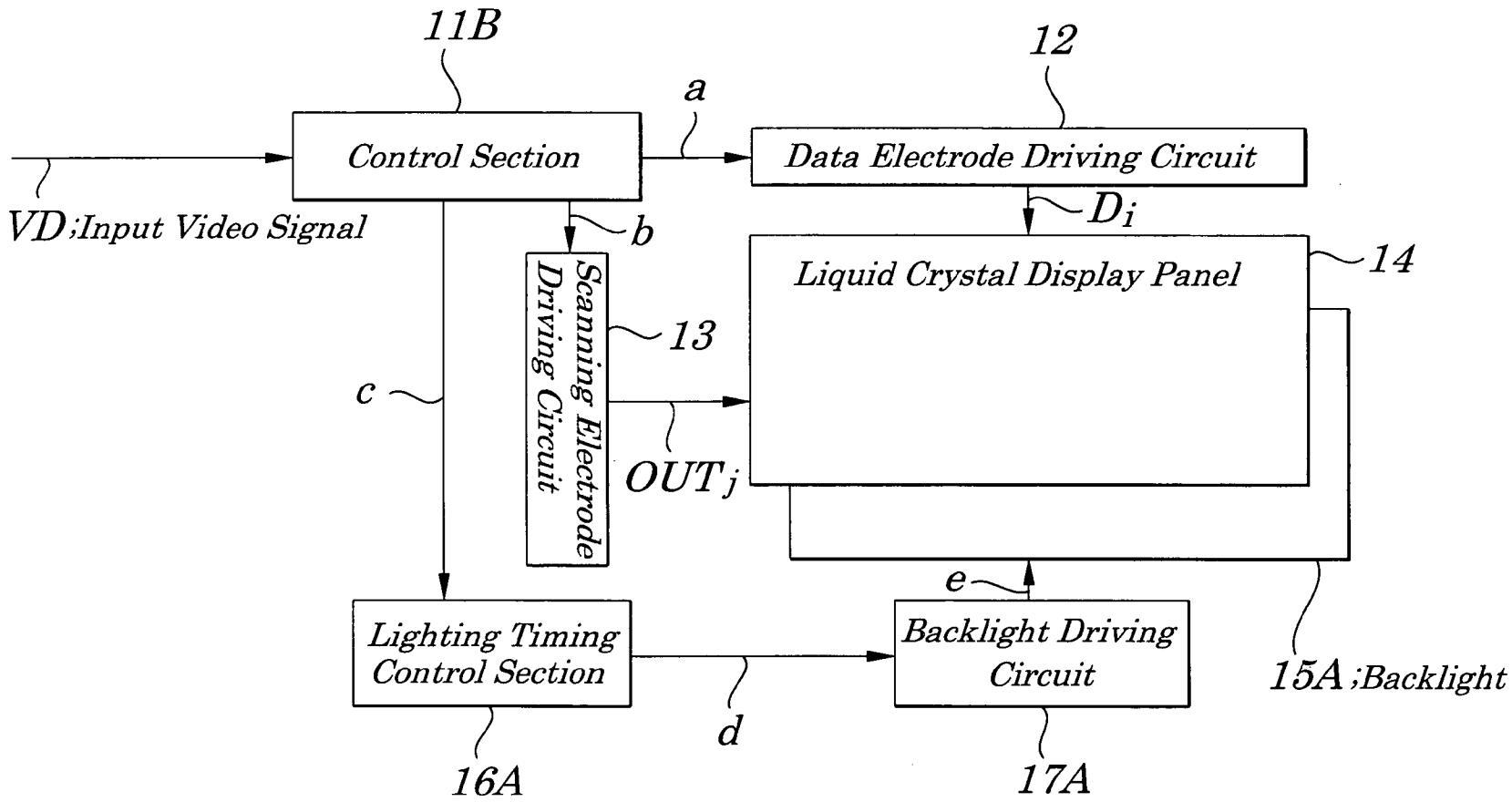
FIG. 8 is a block diagram showing electrical configurations of main components of a liquid crystal display device according to a third embodiment of the present invention.

FIG. 8 is a block diagram showing electrical configurations of main components of a liquid crystal display device according to a third embodiment of the present invention. The liquid crystal display device of the third embodiment, as shown in FIG. 8, includes, instead of the control section 11, the backlight 15, the lighting timing control section 16, and the backlight driving circuit 17 shown in FIG. 1, a control section 11B, a backlight 15A, a lighting timing control section 16A, and a backlight driving circuit 17A, each of which has a function being different from that provided by each of the components shown in FIG. 1. The backlight 15A is made up of LEDs as in the case of the backlight 15, but made up of one light emitting region and is not divided into two portions.

The control section 11B, as in the case of the control section 11, sends out a controlling signal "a" to a data electrode driving circuit 12, a controlling signal "b" to the scanning electrode driving circuit 13, and a controlling signal "c" to the lighting timing control section 16A, based on an input video signal VD. In the third embodiment in particular, the control section 11B divides each frame of the input video signal VD having a specified frequency into eight sub-frames each having a sub-frame frequency as large as the specified frequency and performs an overdriving operation in the first sub-frame and a normal driving operation in the second sub-frame and thereafter on each of pixel regions $\mathbf{20}_{i,j}$. Moreover, the control section 11B inverts, in every sub-frame contained in one frame, a polarity of a voltage of a displaying signal $D_i$ to be applied to each of the pixel regions $\mathbf{20}_{i,j}$ or makes the polarity be the same in each sub-frame. Also, the control section 11B inverts, in each of continuous frames, the polarity of a voltage of the displaying signal $D_i$ to be applied to each of the pixel regions $\mathbf{20}_{i,j}$.

The lighting timing control section 16A generates, based on the controlling signal "c" fed from the control section 11B, a timing signals "d" to make the backlight 15A flash two times at specified time intervals during one frame period at a frequency being two times as large as the frame frequency. The backlight driving circuit 17A generates a driving pulse voltage "e" in synchronization with the timing signal "d" fed from the lighting timing control section 16A and supplies the voltage to the backlight 15A. Configurations other than described above are the same as those in FIG. 1.

Figure 9:
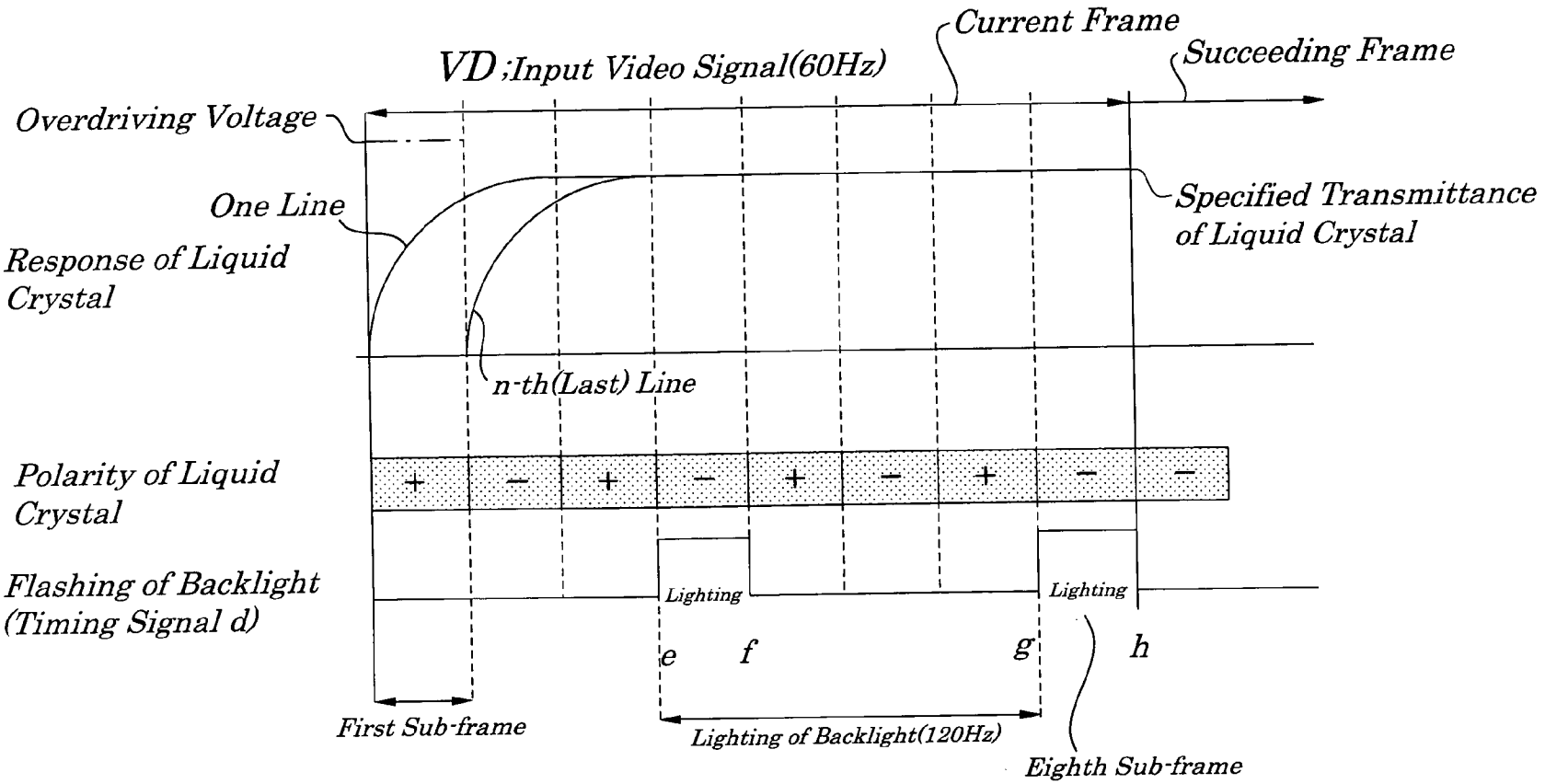
FIG. 9 is a time chart explaining operations of the liquid crystal display device of FIG. 8.

FIG. 9 is a time chart explaining operations of the liquid crystal display device of FIG. 8. By referring to FIG. 9, processing of driving the liquid crystal display device of the third embodiment is described below. In the liquid crystal display device, as shown in FIG. 9, one frame of an input video signal VD is divided into eight sub-frames (first to eighth sub-frame) and the frequency of the displaying signal $D_i$ to be written into the liquid crystal display panel 14 is eight times as large as the frequency before being divided. In the first sub-frame, in order to speed up a response of each of the liquid crystals $\mathbf{22}_{i,j}$, an overdriving operation is performed and, in the second to eighth sub-frame, a normal driving operation is performed. The backlight 15A starts lighting at time "e" when a response for the n-th (last) line of the liquid crystal display panel 14 is almost complete (for example, 70% or more of the response of the liquid crystals $\mathbf{22}_{i,j}$, more preferably 90% or more is reached) and turns off around at time "f" when the fourth sub-frame ends and starts lighting at time "g" when the eighth sub-frame starts and turns off at time "h" when the eighth sub-frame ends. Therefore, the backlight 15A flashes at a frequency of 120 Hz when the frame frequency of the input video signal VD is 60 Hz.

Moreover, polarity of a voltage of the displaying signal $D_i$, to be applied to each of the pixel regions $\mathbf{20}_{i,j}$ of the liquid crystal display panel 14, when being positive in the first sub-frame of a current frame, becomes negative in the second sub-frame and, in the third to eighth sub-frame, becomes positive and negative in a repeated manner. Or, in the third to eighth sub-frame, the polarity in the third sub-frame may be maintained as it is, without the application of the displaying signal $D_i$ to the pixel regions $\mathbf{20}_{i,j}$. Thereafter, the polarity of the voltage of the displaying signal $D_i$ becomes negative in the first sub-frame of the succeeding frame. As a result, as in the case of the first embodiment, a polarity of a voltage of the displaying signal $D_i$ is inverted in every frame. This can provide the same advantage as obtained in the first embodiment. Additionally, the backlight 15A is made up of one light emitting region and is not divided, which achieves simplified configurations of the liquid crystal display device.

Fourth Embodiment

Figure 10:
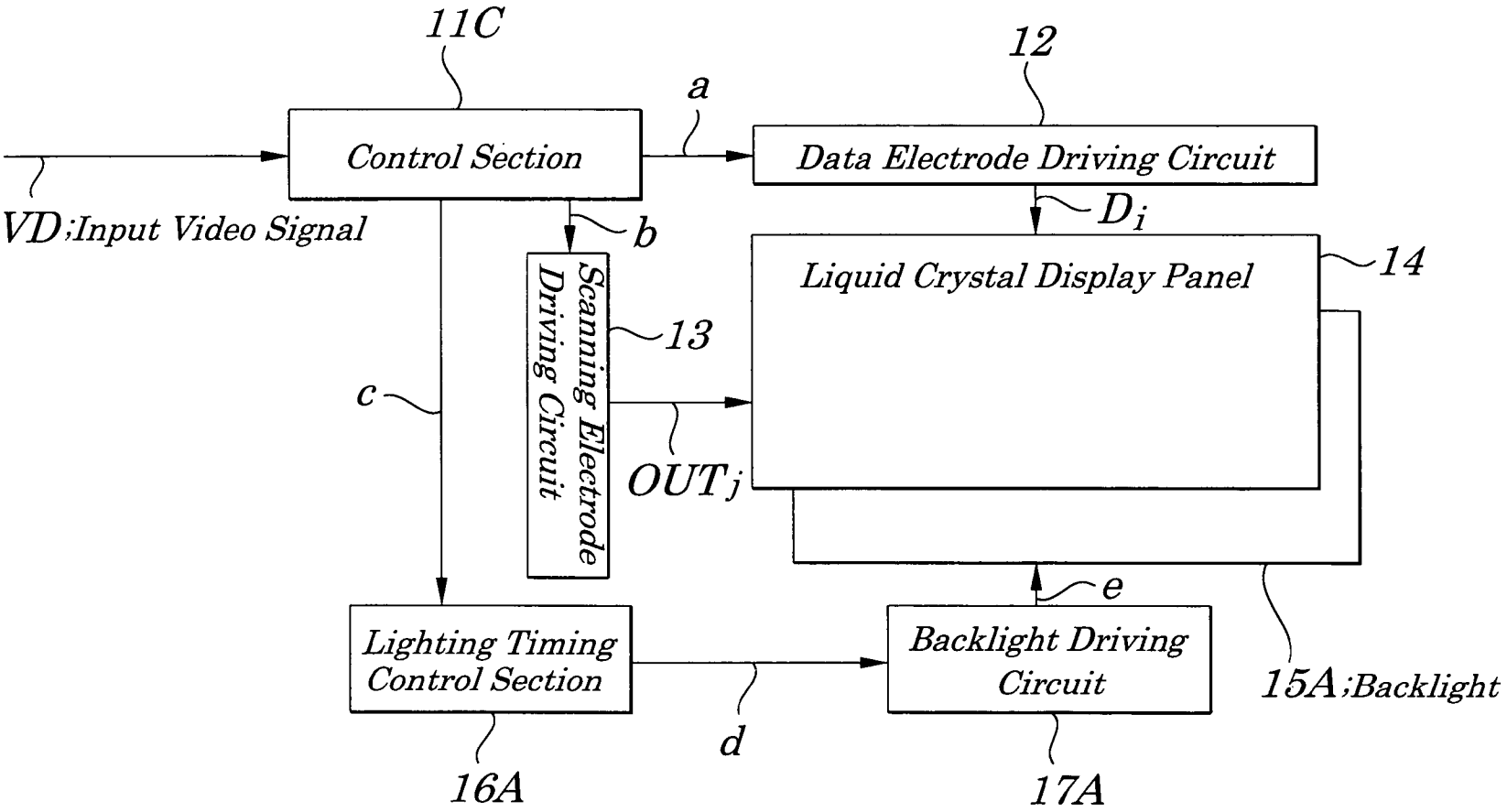
FIG. 10 is a block diagram showing electrical configurations of main components of a liquid crystal display device according to a fourth embodiment of the present invention.

FIG. 10 is a block diagram for showing electrical configurations of main components of a liquid crystal display device of a fourth embodiment of the present invention. In the liquid crystal display device of the fourth embodiment, as shown in FIG. 10, instead of the control section 11B shown in FIG. 8, a control section 11C having a function being different from that of the control section 11B is provided. The control section 11C, in order to make the backlight 15A flash two times during one frame, applies a voltage to each of the pixel regions $\mathbf{20}_{i,j}$ in a manner in which the polarity of the voltage changes in every period during which the backlight 15A is being lit. Configurations other than described here are the same as in FIG. 8.

Figure 11:
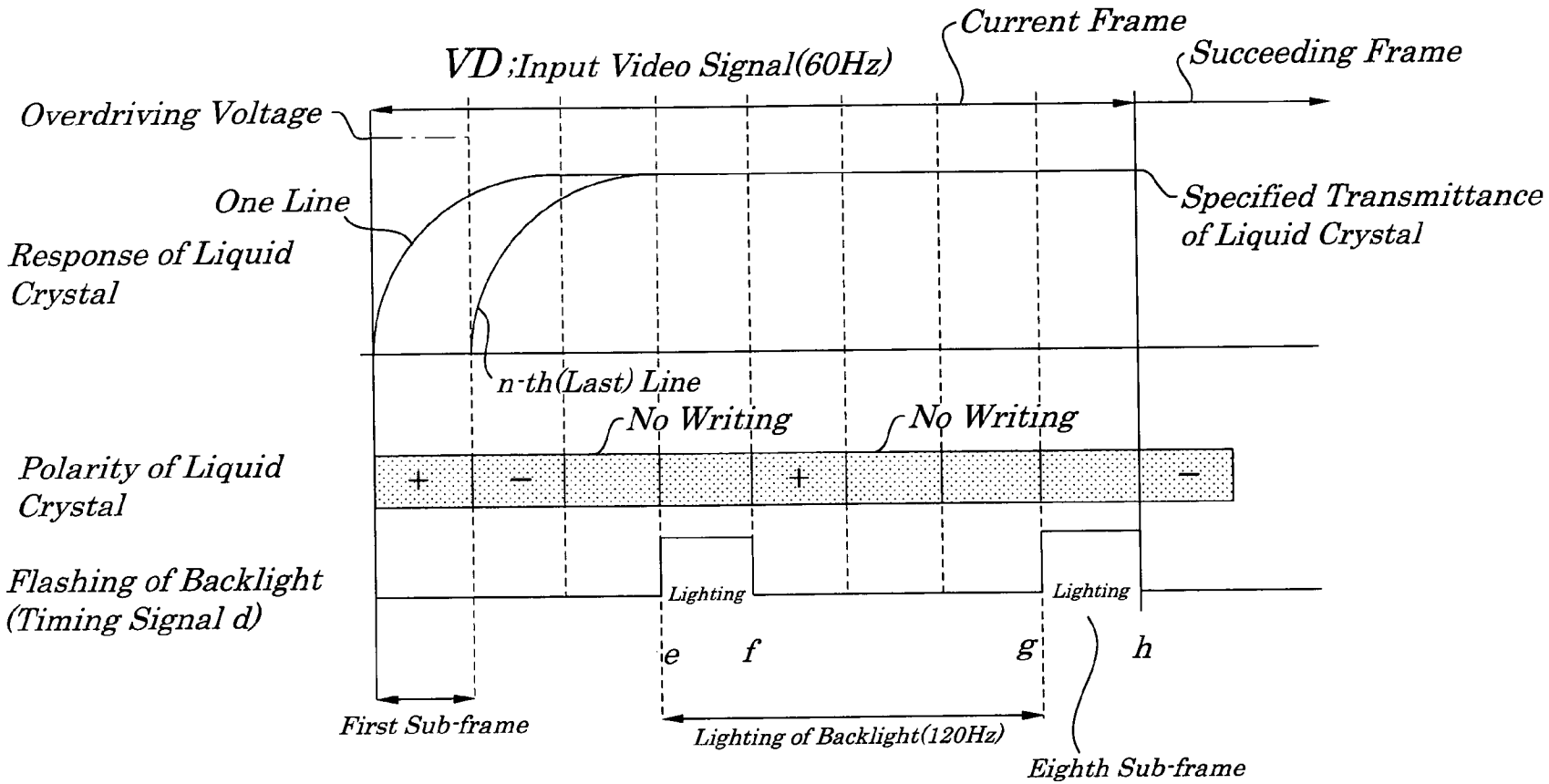
FIG. 11 is a time chart explaining operations of the liquid crystal display device of FIG. 10.
Figure 12:
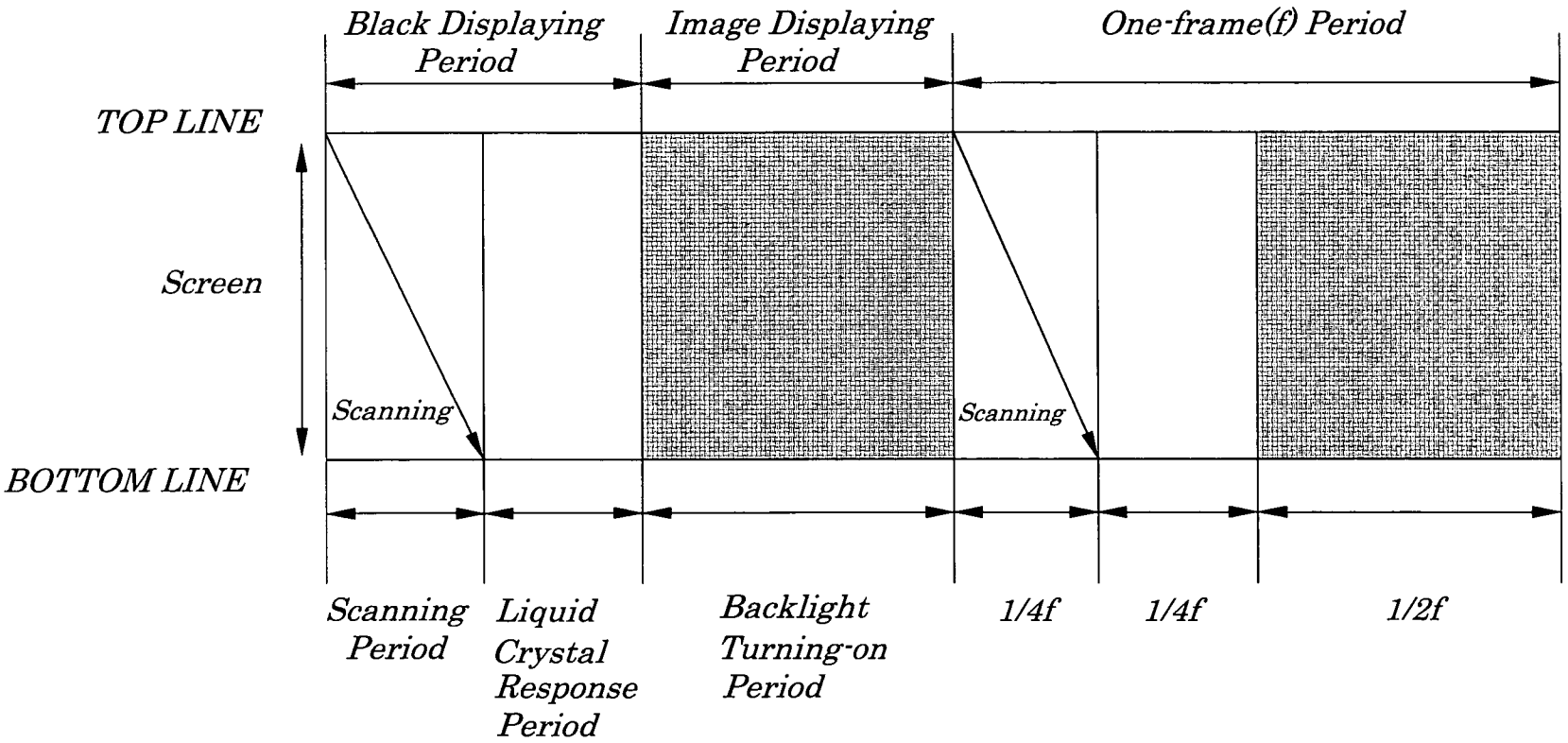
FIG. 12 (RELATED ART)
FIG. 12 is a time chart explaining operations of a conventional liquid crystal display device.
Figure 13:
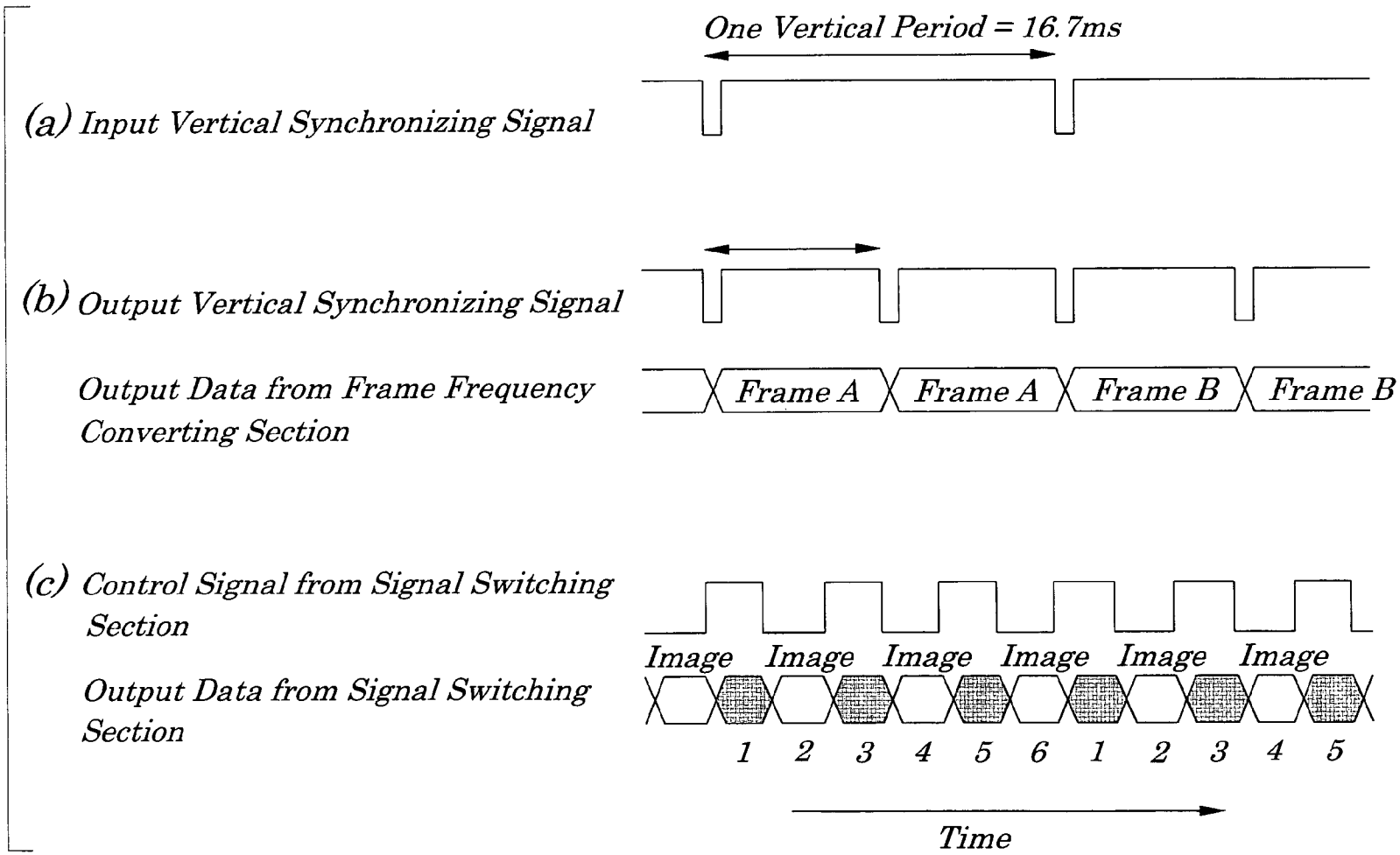
FIG. 13 (RELATED ART)
FIG. 13 is a time chart explaining operations of another conventional liquid crystal display device.

FIG. 11 is a time chart explaining operations of the liquid crystal display device of FIG. 10. By referring to FIG. 11, processing of driving the liquid crystal display device of the fourth embodiment is described below. Operations of the liquid crystal display device of the fourth embodiment differ from those in the third embodiment. That is, as shown in FIG. 11, in the third and fourth sub-frame, the displaying signal $D_i$ may or may not be applied to each of the pixel regions $\mathbf{20}_{i,j}$ of the liquid crystal display panel 14. Also, the displaying signal $D_i$ is applied in one or more sub-frames out of the fifth to eighth sub-frames. In this case, the displaying signal $D_i$ is applied so that the polarity of the displaying signal $D_i$ is inverted during a period between a time "e" and a time "f" and during a period between a time "g" and a time "h". This provides the same advantage as obtained in the second embodiment. Additionally, the configuration of the backlight 15A made up of only one light-emitting region without being divided and achieves simplification of the configurations of the liquid crystal display device.

It is apparent that the present invention is not limited to the above embodiments but may be changed and modified without departing from the scope and spirit of the invention. For example, in each of the embodiments, the data electrode driving circuit 12 simultaneously applies, based on a controlling signal "a", a displaying signal $D_i$ corresponding to an input video signal VD to each of data electrodes $X_i$ of the liquid crystal display panel 14, however, the displaying signal $D_i$ may be applied point-sequentially to each of the data electrodes $X_i$. In the embodiment, the lighting timing control sections 16 and 16A are so configured that timing of turning on or off the backlight 15 and 15A is pre-determined, however, may be configured so as to be calibrated from the outside. In this case, the lighting timing control sections 16 and 16A may be configured so that a response state of the liquid crystals $\mathbf{22}_{i,j}$, is detected by calculating optical transmittance with respect to an applied voltage of the liquid crystals $\mathbf{22}_{i,j}$ using an optical sensor and the timing is controlled according to the result from the detection. Furthermore, in the time charts employed in each of the above embodiment, the polarity of a voltage of the displaying signal $D_i$ to be applied to each of the pixel regions $\mathbf{20}_{i,j}$ represents polarity of one pixel, however, the present invention can be applied to an frame-inversion driving operation, a gate line-inversion driving operation, a dot-inversion driving operation, or a like. Furthermore, a one-time lighting period of the backlight 15 and 15A is not limited to 12. 5% of one frame period.

Also, the frame frequency of a sub-frame is sufficient so long as the frame frequency is four times as large as the frame frequency of an input video signal VD and the frequency of the present invention is not limited to the frame frequency of a sub-frame being four times or eight times as large as the frame frequency of the input video signal VD presented in the above embodiments. Moreover, the frequency at which the LEDs 15*a* and 15*b* of the above embodiments flash is sufficient so long as the frequency is two times as large as a frame frequency of an input video signal VD. Similarly, the frequency at which the backlight 15A of the third and fourth embodiments flashes is sufficient so long as the frequency is two times or more as large as the frame frequency of the input video signal VD and the frequency of the present invention is not limited to the frequency being two times as large as the frame frequency of the input video signal. Furthermore, the liquid crystal display panel 14 shown in FIG. 1 is not limited to configurations shown in FIGS. 2 and 3 and, for example, a liquid crystal display panel of an IPS (In-Plane Switching) type may be employed to carry out the present invention.

The present invention can be applied generally to a liquid crystal display device in which its backlight is made up of LEDs and which is configured to display only moving images and moving/still images having moving images and still images in a mixed manner.

What is claimed is:

1. A liquid crystal display device comprising:

a liquid crystal display panel having a display screen, scanning electrodes and data electrodes to apply a specified voltage to a corresponding pixel region and to control orientation of a liquid crystal to obtain a displayed image;

a backlight to illuminate said liquid crystal display panel from its rear side, said backlight comprising K pieces (K is an integer being 2 or more) of flat backlight blocks which each emit white light; and a driving control unit to divide a specified frame period at which an input video signal is input by frame, into [K×M] pieces of equal sub-frames ([K×M] is an integer being 4 or more) and to perform an overdriving operation on said corresponding pixel region during one frame period in a first sub-frame and to perform a normal driving operation during one frame period in a second sub-frame and thereafter, and to make said flat backlight blocks each flash N (N is an integer being 2 or more) times at specified time intervals during a period of time equivalent to one frame period, said flat backlight blocks sequentially flashing each time, wherein said driving control unit turns off a corresponding flat backlight block continuously before a response of a liquid crystal of said corresponding pixel region to application of said specified voltage is completed and turns on said corresponding flat backlight block at a time point when said response is completed, and wherein said driving control unit inverts a polarity of said specified voltage in every first sub-frame during continuous frame periods and applies said specified voltage to said corresponding pixel region in a manner in which a polarity of said specified voltage is changed in every period of time when said corresponding flat backlight block is being lit during a period of time equivalent to one frame period, each frame period including at least one pair of temporally adjacent sub-frames each being set to have a different polarity of said specified voltage and at least one another pair of temporally adjacent sub-frames being set to have a same polarity of said specified voltage.

2. The liquid crystal display device according to claim 1, wherein said backlight comprises LEDs (Light Emitting Diodes).

3. The liquid crystal display device according to claim 1, wherein said time point when said response of said liquid crystal is completed is set to a time point when said response of said liquid crystal is reached to more than 70% of liquid crystal molecules.

4. The liquid crystal display device according to claim 1, wherein each of said data electrodes of said liquid crystal display panel is arranged in parallel to one another in a first direction at specified intervals and each of said scanning electrodes is arranged in parallel to one another in a second direction orthogonal to said first direction at specified intervals and wherein a light emitting region of said backlight is divided into k (k is an integer being 2 or more)-pieces of said flat backlight blocks along said second direction of said liquid crystal display panel and wherein said driving control unit is so configured as to make said flat backlight blocks each flash in a manner to correspond to a response of said liquid crystal corresponding to each of said flat backlight blocks.

5. The liquid crystal display device according to claim 1, wherein, in said liquid crystal display panel, one dot is made up of three color pixels of red (R), green (G), and blue (B).

6. The liquid crystal display device according to claim 5, wherein, in said liquid crystal display panel, the one dot is made up of the three color pixels of red (R), green (G), and blue (B) provided with color filters of red (R), green (G), and blue (B).

7. A driving control circuit to be used for a liquid crystal display device comprising a liquid crystal display panel having a display screen, scanning electrodes and data electrodes to apply a specified voltage to a corresponding pixel region and to control orientation of a liquid crystal to obtain a displayed image, and a backlight to illuminate said liquid crystal display panel from its rear side, said backlight comprising K pieces (K is an integer being 2 or more) of flat backlight blocks which each emit white light, said driving control unit comprising:

a control section to divide a specified frame period at which an input video signal is input by frame, into [K×M] pieces of equal sub-frames ([K×M] is an integer being 4 or more) and to perform an overdriving operation on said corresponding pixel region during one frame period in a first sub-frame and to perform a normal driving operation during one frame period in a second sub-frame and thereafter, and a lighting timing control section to generate timing signals to make said flat backlight blocks each flash N (N is an integer being 2 or more) times at specified time intervals during a period of time equivalent to one frame period, said flat backlight blocks sequentially flashing for each time, and a backlight driving circuit to generate driving pulse voltages in synchronization with said timing signals fed from said lighting timing control section and to apply the generated driving pulse voltages to said flat backlight blocks, wherein said control section turns off a corresponding flat backlight block, continuously before a response of a liquid crystal of said corresponding pixel region to application of said specified voltage is completed and turns on said corresponding flat backlight block at a time point when said response is completed, and wherein said control section inverts a polarity of said specified voltage in every first sub-frame during continuous frame periods and applies said specified voltage to said corresponding pixel region in a manner in which a polarity of said specified voltage is changed in every period of time when said corresponding flat backlight block is being lit during a period of time equivalent to one frame period, each frame period including at least one pair of temporally adjacent sub-frames each being set to have a different polarity of said specified voltage and at least one another pair of temporally adjacent sub-frames being set to have a same polarity of said specified voltage.

8. The driving control circuit according to claim 7, wherein, in said liquid crystal display panel, one dot is made up of three color pixels of red (R), green (G), and blue (B).

9. The driving control circuit according to claim 8, wherein, in said liquid crystal display panel, one dot is made up of three color pixels of red (R), green (G), and blue (B) provided with color filters of red (R), green (G), and blue (B).

10. A driving method to be used for a liquid crystal display device which comprises a liquid crystal display panel having a display screen, scanning electrodes and data electrodes to apply a specified voltage to a corresponding pixel region and to control orientation of a liquid crystal to obtain a displayed image, and a backlight to illuminate said liquid crystal display panel from its rear side, said backlight comprising K-pieces (K is an integer being 2 or more) of flat backlight blocks which each emit white light, said driving method comprising:

dividing a specified frame period at which an input video signal is input by frame, into [K×M] pieces of equal sub-frames ([K×M] is an integer being 4 or more), performing an overdriving operation on said corresponding pixel region during one frame period in a first sub-frame, performing a normal driving operation during one frame period in a second sub-frame and thereafter, inverting a polarity of said specified voltage in every first sub-frame during continuous frame periods, making said flat backlight blocks each flash N (N is an integer being 2 or more) times at specified time intervals during a period of time equivalent to one frame period, said flat backlight blocks sequentially flashing for each time, and applying a voltage to said corresponding pixel region in a manner in which a polarity of said specified voltage is changed in every period of time when said flat backlight blocks each are being lit during a period of time equivalent to one frame period, wherein a corresponding flat backlight block is turned off continuously before a response of a liquid crystal of said corresponding pixel region to application of said specified voltage is completed said corresponding flat backlight block is turned on at a time point when said response is completed, and wherein a polarity of said specified voltage is inverted in every first sub-frame during continuous frame periods and said specified voltage is applied to said corresponding pixel region in a manner in which a polarity of said specified voltage is changed in every period of time when said corresponding flat backlight block is being lit during a period of time equivalent to one frame period, each frame period including at least one pair of temporally adjacent sub-frames each being set to have a different polarity of said specified voltage and at least one another pair of temporally adjacent sub-frames being set to have a same polarity of said specified voltage.

11. The driving method according to claim 10, wherein, in said liquid crystal display panel, one dot is made up of three color pixels of red (R), green (G), and blue (B).

12. The driving method according to claim 11, wherein, in said liquid crystal display panel, one dot is made up of three color pixels of red (R), green (G), and blue (B) provided with color filters of red (R), green (G), and blue (B).

13. A liquid crystal display device comprising:

a liquid crystal display panel having a display screen, scanning electrodes and data electrodes to apply a specified voltage to a corresponding pixel region and to control orientation of a liquid crystal to obtain a displayed image;

a backlight to illuminate said liquid crystal display panel from its rear side, said backlight comprising K pieces (K is an integer being 2 or more) of flat backlight blocks which each emit white light; and a driving control unit to divide a specified frame period at which an input video signal is input by frame, into [K×M] pieces of equal sub-frames ([K×M] is an integer being 4 or more) and to perform an overdriving operation on said corresponding pixel region during one frame period in a first sub-frame and to perform a normal driving operation during one frame period in a second sub-frame and thereafter, and to make said flat backlight blocks each flash N (N is an integer being 2 or more) times at specified time intervals during a period of time equivalent to one frame period, said flat backlight blocks sequentially flashing for each time, wherein said driving control unit turns off a corresponding flat backlight continuously before a response of a liquid crystal of said corresponding pixel region to application of said specified voltage is completed and turns on said corresponding flat backlight block at a time point when said response is completed, and wherein said driving control unit applies said specified voltage to said corresponding pixel region in a manner in which a polarity of said specified voltage is changed in every period of time when said corresponding flat back-light block is being lit during a period of time equivalent to one frame period, each frame period including at least one pair of temporally adjacent sub-frames each being set to have a different polarity of said specified voltage and at least one another pair of temporally adjacent sub-frames being set to have a same polarity of said specified voltage.

14. The liquid crystal display device according to claim 13, wherein, in said liquid crystal display panel, one dot is made up of three color pixels of red (R), green (G), and blue (B).

15. The liquid crystal display device according to claim 14, wherein, in said liquid crystal display panel, one dot is made up of three color pixels of red (R), green (G), and blue (B) provided with color filters of red (R), green (G), and blue (B).

* * * * *